United States Patent [19]

Connell et al.

[11] 3,992,911

[45] Nov. 23, 1976

[54] DIAMETRAL CONTROL OF ROLLED ANNULAR WORKPIECES BY WEIGHING

[75] Inventors: Gordon Sidney Connell; Ronald Carl Andriessen, Cheltenham, both of England

[73] Assignee: Formflo Limited, Cheltenham, England

[22] Filed: July 21, 1975

[21] Appl. No.: 597,739

[30] Foreign Application Priority Data

July 24, 1974 United Kingdom ..... 32783/74

[52] U.S. Cl. ..... 72/7; 72/106; 72/108; 72/110

[51] Int. Cl.[2] ..... B21H 1/12

[58] Field of Search ..... 72/7, 22, 23, 102, 105, 72/106, 107, 108, 110; 29/148.4 R

[56] References Cited

UNITED STATES PATENTS 3,839,892 10/1974 Andriessen ..... 72/108

*Primary Examiner*—Lowell A. Larson

*Attorney, Agent, or Firm*—Pollock, Vande Sande & Priddy

[57] ABSTRACT

A method of roll forming an annular workpiece to a desired shape from a workpiece having dimensions within a tolerance range, in which the difference in weight between the workpiece and a nominally sized workpiece is determined and the workpiece is then roll formed to its desired shape by being squeezed between at least two rotating forming members which advance relatively towards one another to a fully advanced position to impress the desired shape into the workpiece followed by maintaining the forming members at their fully advanced position to complete the roll forming for a period of time known as the dwell time. The extent of advancement of the forming members or the dwell time is varied from the standard required for the nominally sized workpiece in dependence upon the difference in weight of the workpiece from the nominally sized workpiece so as to produce a final rolled workpiece whose diameter is substantially identical with that of a nominally sized workpiece subjected to the standard extent of advancement of the forming members or dwell time.

12 Claims, 2 Drawing Figures

DIAMETRAL CONTROL OF ROLLED ANNULAR WORKPIECES BY WEIGHING

This invention relates to the rolling of shaped bearing rings from annular workpieces and in particular relates to the rolling of inner and outer bearing races from cylindrical workpieces.

BACKGROUND TO THE INVENTION

In U.S. Pat. No. 3,839,892 there is disclosed a method of ensuring that the dimensions of a rolled ring are accurate by determining the variations in the dimensions of a workpiece from a nominally sized workpiece and then rolling the rings to a depth dependent on the magnitude of the variations or rolling the rings to a constant depth and maintaining the rolls at that depth for a time (dwell time) dependent on the magnitude of the variations.

There is also disclosed a roll forming machine for carrying out that method in U.S. Pat. No. 3,803,890 and 3,839,892.

The difference between the required depth of rolling or dwell time for a given workpiece and that for a nominal sized workpiece is determined by an algebraic relationship formulated from the difference between the wall thickness, width and mean diameter of a nominal sized workpiece and the workpiece under consideration. This method is in fact a way of ensuring diametral control by measuring dimensional variations of a workpiece from the nominal.

This invention differs from that disclosed in U.S. Pat. No. 3,839,892 in that the dimensional variations of the workpiece from the nominal are calculated by measuring the weight variations instead of dimensional variations.

BRIEF DESCRIPTION OF THE INVENTION

According to one aspect of the invention there is provided a method of roll forming an annular workpiece to a desired shape from a annular workpiece having dimensions within a tolerance range, in which the variations in the weight of the annular workpiece from a nominally sized workpiece is determined and the workpiece is then roll formed to its desired shape by being squeezed between at least two rotating forming members at least one of which advances relatively towards the another to a fully advanced position to impress the desired shape into the workpiece followed by maintaining the forming members at their fully advanced position to complete the roll forming for a period of time known as the dwell time, and in which extent of advancement of the forming members is varied from the standard required for the nominally sized workpiece in dependence upon the variations in the weight of the cylindrical workpiece from the nominally sized workpiece so as to produce a final rolled workpiece whose diameter is substantially identical with that of a nominally sized workpiece subjected to the standard extent of advancement of the forming members.

According to another aspect of the invention there is provided a method of roll forming an annular workpiece to a desired shape from an annular workpiece having dimensions within a tolerance range, in which the variations in the dimensions of the annular workpiece from a nominally sized workpiece is determined and the workpiece is then roll formed to its desired shape by being squeezed between at least two rotating forming members at least one of which advances relatively towards the other to a fully advanced position to impress the desired shape into the workpiece followed by maintaining the forming members at their fully advanced position to complete the roll forming for a period of time known as the dwell time, and in which the dwell time is varied from the standard required for the nominally sized workpiece in dependence upon the variations in the weight of the annular workpiece from the nominally sized workpiece so as to produce a final roller workpiece whose diameter is substantially identical with that of a nominally sized workpiece subjected to the standard extent of dwell time.

According to another aspect of the invention there is provided a roll forming machine for forming cylindrical workpieces comprising:

a. at least two forming members, b. means for advancing at least one forming member towards the other to advanced positions to squeeze said annular workpieces to a desired shape, maintaining said forming members at said advanced positions for a period known as dwell time and thereafter returning said forming members away from one another, c. means for measuring the weight of said cylindrical workpieces before forming, d. means, coupled to said last named means, for computing variations in the weight of a workpiece from a nominally sized workpiece, and e. means, controlled by said means for computing and coupled to said means for advancing, for varying the extent of advancement of said at least one member from the standard required for said nominally sized workpiece, said variation being fed in accordance with said computed variations in the weight of said workpiece, whereby a final rolled workpiece has a final rolled diameter substantially identical with that of said nominally sized workpiece subjected to said standard extent of advancement.

According to another aspect of the invention there is provided a roll forming machine for forming cylindrical workpieces comprising:

a. at least two forming members, b. means for advancing at least one forming member towards the other to advanced positions to squeeze said annular workpieces to a desired shape, maintaining said forming members at said advanced positions for a period known as dwell time and thereafter returning said forming members away from one another, c. means for measuring the weight of said cylindrical workpieces before forming, d. means, coupled to said last named means, for computing variations in the weight of a workpiece from a nominally sized workpiece, and e. means, controlled by said means for computing and coupled to said means for advancing, for varying the extent of the dwell time from the standard required for said nominally sized workpiece, said variation being set in accordance with said computed variations in the weight of said workpiece, whreby a final rolled workpiece has a final rolled diameter substantially identical with that of said nominally sized workpiece subjected to said standard extent of dwell time.

For identical materials weight is directly proportional to volume. The workpiece from which bearings are rolled are usually cut from a long bar, and variations in the wall thickness of the workpieces have a definite effect on their mean rolled diameter. As described U.S.

Pat. No. 3,839,892 the ratio between mean rolled diameter variation and wall thickness variation can be of the order of 8 : 1.

If the wall thickness of the blank is increased by 0.001 inches and the machine stop is set for no variation then the mean rolled diameter variation will increase by 0.008 inches. It can be also shown by calculation that within normal workpiece blank tolerances the greatest influence on weight variation is caused by variation in wall thickness. The other blank dimensions, i.e. mean diameter and width, have considerably less effect on the rolled diameter and consequently weight variations caused by these dimensions are taken into account by weighing an automatically assessed as a total with the wall thickness variation.

This method takes into account surface finish and chamfer variations which are not considered in the method described in U.S. Pat. No. 3,839,892. Also weight variations are easier to compute for analoque or digital purposes. The weighing can be performed by using a load cell or a direct reading weighing unit for example on Avery dead weight weighing system or a series 6005C weighing cell obtainable from Hunting Engineering Ltd., Bedford, England. Before performing the rolling operation the volume and dimensional tolerances of a nominal size ring are converted to their weight equivalent. Then the same operation is conducted on the workpiece under consideration. These resultant variations can be transmitted to a stepping motor which can rotate an adjustable stop until it reaches the correct position. to give the required depth of roll. l Alternatively instead of adjusting the depth of roll according to weight variation the dwell time can be adjusted and the depth of roll kept constant. Both these methods of diametral control using dimentional variations are described in U.S. Pat. NO. 3,839,892 to which reference is directed.

Instead of using the above described method of adjusting the depth of roll, a transducer which can also be obtained from the Hunting Engineering Ltd. can be arranged in the vicinity of the rolls. This transducer can convert the movement of the roll head into, for example, a voltage or pulses which can stop the advancement of the rolls when the voltage or pulses reach a certain magnitude dependent in the difference between the weight of the ring being rolled and that of a nominal size ring.

The advantages of this invention include the fact that obtaining the volume by weighing takes into account all factors affecting volume whereas the previous measuring system ignored such items as chamfer, surface finish and taper conditions.

Also as in the invention described in U.S. Pat. No. 3,839,892 "bore ripple" can be eliminated. This phenomenon arises from the fact that the force exerted by a forming roll is greatest in the region where maximum forming is taking place. This results in the bore of the workpiece being deformed in such a manner as to correspond with the formed shape of the workpiece.

Thirdly, the side face extrusion can be considerably reduced and can be kept constant.

Another advantage is that a workpiece blank tolerance can be increased to approximately ±0.005 inch depending on the size and type of the ring.

Finally, the work done during the forming operation can be kept constant.

The invention will be further described by way of example and with reference to the accompanying drawings.

DESCRIPTION OF PREFERRED EMBODIMENTS

Figure 1:
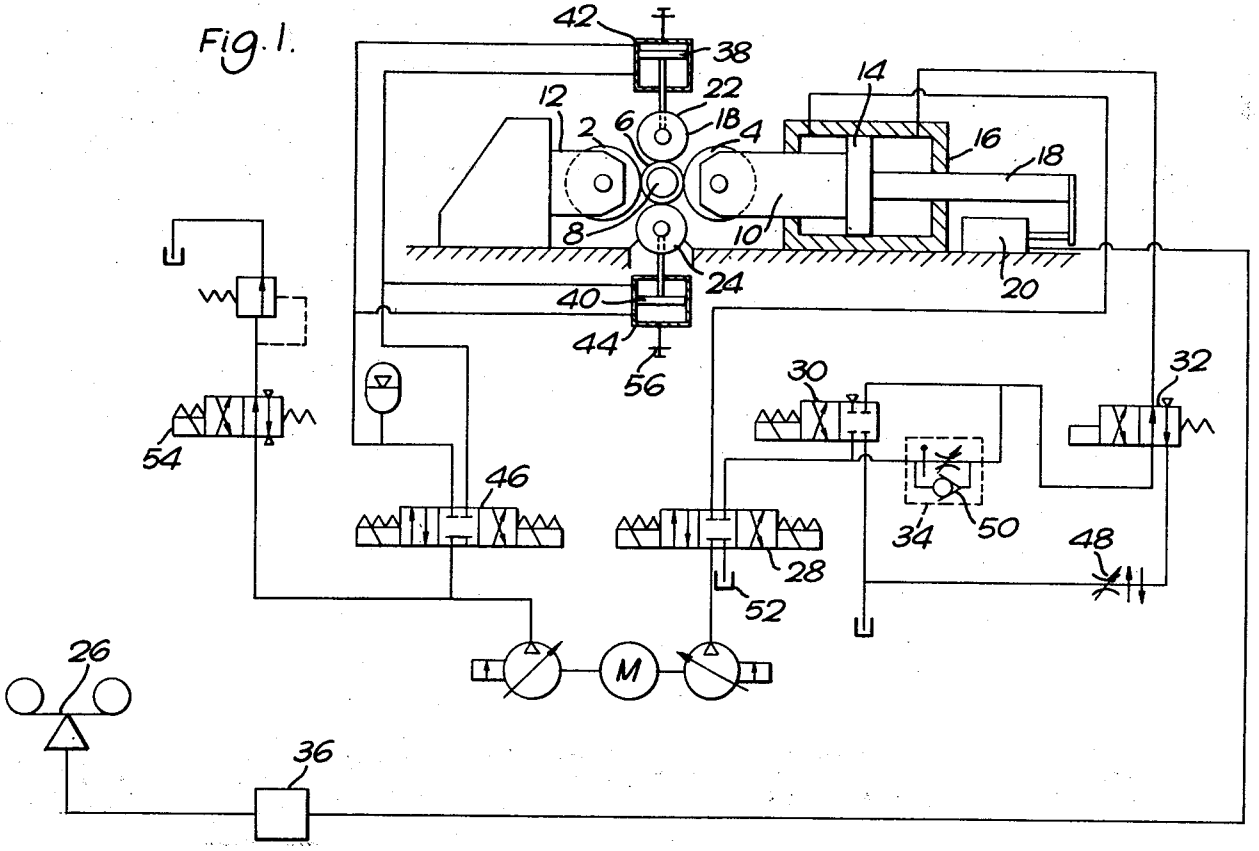
FIG. 1 shows a side view of a rolling machine for rolling a profile into the outer surface of annualr workpiece, together with a hydraulic circuit for operating the machine.

Regarding FIG. 1, the rolling machine has two opposed forming rolls 2 and 4, between which is supported an annular workpiece 6 on a mandrel 8. The mandrel can be, for example, a split mandrel as described in our copending application No. 597,740 filed concurrently herewith. In the embodiment shown in FIG. 1 only the right hand roll 4 can be moved horizontally towards and away from the workpiece 6 but a rolling machine having both forming rolls movable can be used. This would involve only a simple change in the hydraulic circuitry. Both forming rolls 2 and 4 are each supported in a respective yoke 10 and 12. Yoke 10 is fixed but yoke 12 is connected to a piston 14 which is movable inside a cylinder 16. The piston is in turn connected by means of a piston rod 18 to a digital or analoque transducer 20.

At right angles to the forming rolls 2 and 4 are two opposed growth control rolls 22 and 24 for reducing any ovality in the workpiece 6 produced by the forming rolls 2 and 4 during rolling. The growth control rolls are rotatably supported by any suitable means such as that described in U.S. Pat. No. 3,803,890.

Prior to the rolling operation the annular workpiece 6 to be rolled is weighed in a weighing unit 26. The difference in weight between the workpiece 6 under consideration and a nominally sized workpiece produces a digital or analoque output signal during rolling. After weighing the workpiece 6 is inserted in the rolling machine ready for the start of the rolling operation.

To advance the forming roll 4, hydraulic fluid is pumped to a change over valve 28, which is set in the position which allows fluid to be conveyed to the back of the piston 14 to advance the roll 4. From the changeover valve 28 the hydraulic fluid passes via two other changeover valves 30 and 32 to the back of piston 14 which is thereby made to advance under the pressure of the fluid. The initial advancement of the forming roll 4 is relatively fast, but when the forming roll 4 is nearly in contact with the workpiece 6 its speed of advancement is slowed down by switching the changeover valve 30 so that the hydraulic fluid passes through a flow control valve 34.

As the forming roll 4 advances its movement is converted, by the transducer 20 to a signal, such as a voltage, which is compatible with that produced by the weighing unit 26, and these two signals are compared in a factoring unit 36. When the signals from the transducer 20 and the weighing unit 26 correspond the factoring unit 36 switches the changeover valve 28 to prevent hydraulic fluid continuing to flow to the back of piston 12.

When the forming roll 4 is fully advanced it remains in the advanced position for a period of time known as the dwell time. The extent of advancement of the forming roll 4 or the dwell time depends on the difference between the weight of the workpiece being rolled and the weight of a nominally sized workpiece.

As mentioned above the rolling machine also includes a pair of growth control rolls 22 and 24. Each growth control roll 22 and 24 is connected to a respective piston 38 and 40 which is movable inside a cylinder 42 and 44. During rolling hydraulic fluid is supplied to the back of pistons 38 and 40 via a changeover valve 46. This allows the pistons 38 and 40 to advance as the form is produced in the workpiece, keeping the growth control rolls 22 and 24 in contact with the workpiece 6 with sufficient force to prevent the workpiece from distorting to any large extent.

When the forming roll 4 reaches a predertimed depth of roll the force exerted by the growth control rolls are locked into position. There extent of advancement is regulated by fixed adjustable stops which are described in more detail in our co-pending application Ser. No. 597,738, filed concurrently herewith.

After the completion of the dwell time change over 28 is switched so that hydraulic fluid can pass to the front of piston 14 thereby causing the forming roll 4 to retract. The retraction of the forming roll 4 in turn causes hydraulic fluid to flow to changeover valve 32 which is now set so that fluid passes through a slow-back off control valve 48. This control valve 48 limites the speed with which the forming roll can retract. The roll is initially retracted slowly to prevent any distortion in the shape of the rolled workpiece which could occur if the forming rolls 4 was retracted to fast. After the forming roll 4 has been retracted a predertermined distance its speed of retraction can safely be increased. This is effected by switching the changeover valve 32 so that hydraulic fluid flows through check valve 50 then back to a hydraulic fluid resevoir 52 via changeover valve 28.

Figure 2:
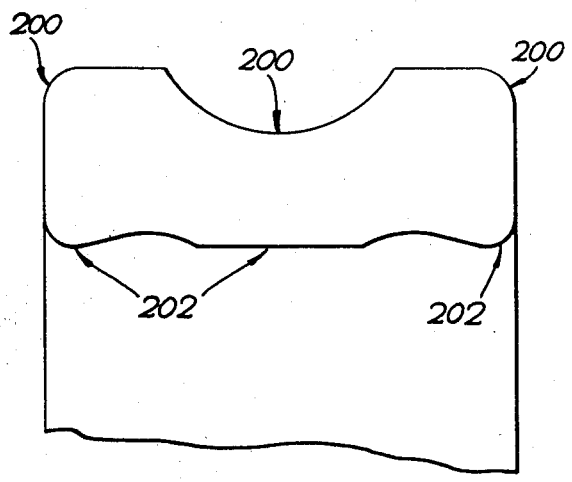
FIG. 2 shows the effect of 'bore ripple' in a rolled ring.

FIG. 2 shows a section of a bearing ring. The maximum forming force is generated at the formed region, indicated by numeral 200. As a result a corresponding deformation is produced at the region 202. This deformation may only be a few thousandths of an inch but its effect is far from negligible. By using the method according to the invention this "bore ripple" phenomenon can be reduced and sometimes even eliminated.

We claim:

1. A method of roll forming an annular workpiece to a desired shape from an annular workpiece having dimensions within a tolerance range, in which the variations in the weight of the annular workpiece from a nominally sized workpiece is determined and the workpiece is then roll formed to its desired shape by being squeezed between at least two rotating forming members at least one of which advances relatively towards the other to a fully advanced position to impress the desired shape into the workpiece followed by maintaining the forming members at their fully advanced position to complete the roll forming for a period of time known as the dwell time, and in which extent of advancement of the forming members is varied from the standard required for the nominally sized workpiece in dependence upon the variations in the weight of the cylindrical workpiece from the nominally sized workpiece so as to produce a final rolled workpiece whose diameter is substantially identical with that of a nominally sized workpiece subjected to the standard extent of advancement of the forming members.

2. A method as claimed in claim 1 for the roll forming of a profile into the outer facing surface of the workpiece, in which the workpiece is rotatably mounted on a mandrel and profile is impressed into the workpiece by a pair of diametrically opposed forming rolls.

3. A method as claimed in claim 1 in which the extent of advancement of the forming members is varied by one or more stops whose positions are adjusted in dependence upon the variations in the weight of the annular workpiece from the nominally sized workpiece.

4. A method as claimed in claim 3 in which the forming members are advanced relative to one another by one or more hydraulic rams, the pistons of the rams having the adjustable stops which prevent further advance the forming members once the required extent of advancement to give the required diametrical size of the workpiece has been reached.

5. A method of roll forming an annular workpiece to a desired shape from an annular workpiece having dimensions within a tolerance range, in which the variations in the weight of the annular workpiece from a nominally sized workpiece is determined and the workpiece is then roll formed to its desired shape by being squeezed between at least two rotating forming members at least one of which advances relatively towards the other to a fully advanced position to impress the desired shape into the workpiece followed by maintaining the forming members at their fully advanced position to complete the roll forming for a period of time known as the dwell time, and in which the dwell time is varied from the standard required for the nominally sized workpiece in dependence upon the variations in the weight of the annular workpiece from the nominally sized workpiece so as to produce a final rolled workpiece whose diameter is substantially identical with that of a nominally sized workpiece subjected to the standard extent of dwell time.

6. A method as claimed in claim 5 for the roll forming of a profile into the outer facing surface of the workpiece, in which the workpiece is rotatably mounted on a mandrel and profile is impressed into the workpiece by a pair of diametrically opposed forming rolls.

7. A roll forming machine for forming cylindrical workpieces comprising:

a. at least two forming members;

b. means for advancing at least one forming member towards the other to advanced positions to squeeze said annular workpieces to a desired shape, maintaining said forming members at said advanced positions for a period known as dwell time and thereafter retracting said forming members away from one another;

c. means for measuring the weight of said cylindrical workpieces before forming;

d. means, coupled to said last named means, for computing variations in the weight of a workpiece from a nominally sized workpiece; and e. means, controlled by said means for computing and coupled to said means for advancing, for varying the extent of advancement of said at least one member from the standard required for said nominally sized workpiece, said variation being in accordance with said computed variations in the weight of said workpiece, whereby a final rolled workpiece has a final rolled diameter substantially identical with that of said nominally sized workpiece subjected to said standard extent of advancement.

8. A roll forming machine as claimed in claim 7 which has a pair of diametrically opposed forming rolls arranged to be advanced towards one another by one or more hydraulic rams to squeeze the workpiece between them.

9. A roll forming machine as claimed in claim 8 in which the hydraulic ram or rams have an adjustable stop which is arranged to be preset in dependence upon the variations in the weight of a workpiece from a nominally sized workpiece so as to stop advancement of the forming rolls relative to one another at the required depth of roll.

10. A roll forming machine for forming cylindrical workpieces comprising:

a. at least two forming members;

b. means for advancing at least one forming member towads the other to advanced positions to squeeze said annular workpieces to a desired shape, maintaining said forming members at said advanced positions for a period known as dwell time and thereafter returning said forming members away from one another;

c. means for measuring the weight of said cylindrical workpieces before forming;

d. means, coupled to said last named means, for computing variations in the weight of a workpiece from a nominally sized workpiece; and e. means, controlled by said means for computing and coupled to said means for advancing, for varying the extent of the dwell time from the standard required for said monimally sized workpiece, said variation being set in accordance with said computed variations in the weight of said workpiece, whereby a final rolled workpiece has a final rolled diameter substantially identical with that of said nominally sized workpiece subjected to said standard extent of dwell time.

11. A roll forming machine as claimed in claim 10 which has a pair of diametrically opposed forming rolls arranged to be advanced towards one another by one or more hydraulic rams to squeeze the workpiece between them.

12. A roll forming machine as claimed in claim 11 in which the hydraulic ram or rams have a fixed stop which limits the advancement of the forming rolls towards one another, and in which once the ram or rams reach the fixed stop a hydraulic pressure sensitive switch is arranged to actuate a timer which is arranged to control the dwell time and which is arranged to be preset in dependence upon the variations in the weight of a workpiece from a nominally sized workpiece.

* * * * *